US012024781B2

(12) United States Patent
Primavera et al.

(10) Patent No.: US 12,024,781 B2
(45) Date of Patent: Jul. 2, 2024

(54) PICKLING PLANT AND PROCESS

(71) Applicant: DANIELI & C. OFFICINE MECCANICHE S.P.A., Buttrio (IT)

(72) Inventors: Alessandra Primavera, Faedis (IT); Emanuele Trucillo, Buttrio (IT); Luciano Vignolo, Udine (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 192 days.

(21) Appl. No.: 17/594,545

(22) PCT Filed: Apr. 22, 2020

(86) PCT No.: PCT/IB2020/053783
§ 371 (c)(1),
(2) Date: Oct. 21, 2021

(87) PCT Pub. No.: WO2020/217180
PCT Pub. Date: Oct. 29, 2020

(65) Prior Publication Data

US 2023/0031905 A1 Feb. 2, 2023

(30) Foreign Application Priority Data

Apr. 23, 2019 (IT) ..... 102019000006234

(51) Int. Cl.
*C23G 3/02* (2006.01)
*C23G 1/08* (2006.01)

(52) U.S. Cl.
CPC ..... *C23G 3/024* (2013.01); *C23G 1/08* (2013.01); *C23G 3/026* (2013.01); *C23G 3/028* (2013.01)

(58) Field of Classification Search
None
See application file for complete search history.

(56) References Cited

U.S. PATENT DOCUMENTS 4,073,301 A * 2/1978 Mackinnon ..... B08B 3/042 134/65
4,807,653 A 2/1989 Cipriano et al.
(Continued)

FOREIGN PATENT DOCUMENTS

EP 1054079 B1 5/2004
FR 2701410 8/1994
(Continued)

OTHER PUBLICATIONS

"Chinese Application Serial No. 202080031256.2 Non Final Office Action dated Feb. 10, 2023", w English Translation, 10 pgs.
(Continued)

*Primary Examiner* — Natasha N Campbell
*Assistant Examiner* — Pradhuman Parihar
(74) *Attorney, Agent, or Firm* — Schwegman Lundberg & Woessner, P.A.

(57) ABSTRACT

The invention concerns a continuous pickling plant (101) for the treatment of metal products (109) in the form of a strip or tube which includes a plurality of acid solution process tanks (102) each divided into a plurality of turbulence cells (114) and a recirculation system of the acid solution. The plant also includes, upstream of the plurality of process tanks (102), a device for heating (124; 126) the metal product (109), namely an induction heating (124) system and/or a tunnel with water sprays (126). A solution with only two pickling tanks (102) is also presented. Devices are described (135; 136; 138, 138*a*) to increase turbulence in the tanks and to accelerate pickling, e.g. by adding fresh acid (146) in the first tank. The invention also concerns a related pickling process. The invention optimizes the effect of the acid and reduces the residence time of the strip (109) in the plant.

12 Claims, 4 Drawing Sheets

(56) References Cited

U.S. PATENT DOCUMENTS

Figure 1:
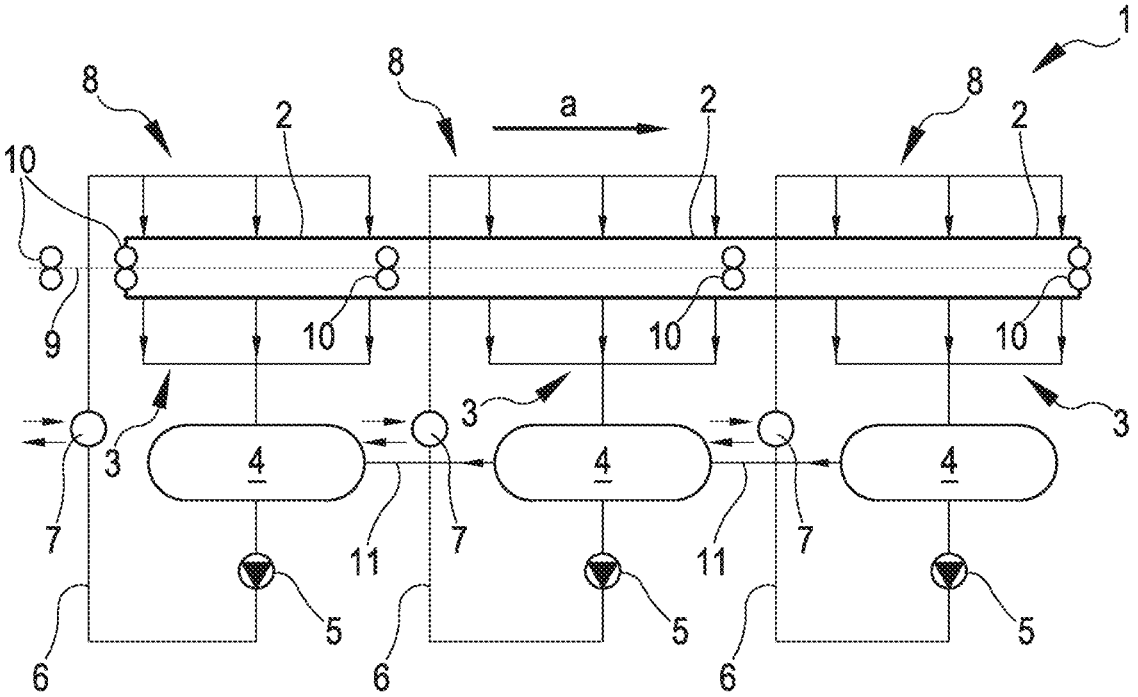

| | | | | |
|---|---|---|---|---|
| 4,996,998 | A | 3/1991 | Seiz et al. | |
| 5,060,683 | A * | 10/1991 | Seiz | C23G 3/021 134/113 |
| 5,466,309 | A * | 11/1995 | Davene | B21B 45/06 266/112 |
| 5,803,981 | A | 9/1998 | Lordo | |
| 6,260,563 | B1 | 7/2001 | Lordo et al. | |
| 2017/0268114 | A1* | 9/2017 | Marx | C23G 1/08 |

FOREIGN PATENT DOCUMENTS

| | | |
|---|---|---|
| FR | 2701493 | 8/1994 |
| JP | 5920478 | 2/1984 |
| JP | 2003277958 | 10/2003 |
| RU | 2005138843 | 6/2007 |
| RU | 2325965 | 6/2008 |

OTHER PUBLICATIONS

"Russian Application Serial No. 2021133411 05, Office Action dated Jun. 7, 2022", w English Translation, (Jun. 7, 2022), 16 pgs.
"International Application Serial No. PCT/IB2020/053783, International Preliminary Report on Patentability dated Aug. 6, 2021", (Aug. 6, 2021), 17 pgs.
"International Application Serial No. PCT/IB2020/053783, International Search Report dated Jul. 21, 2020", (Jul. 21, 2020), 4 pgs.
"International Application Serial No. PCT/IB2020/053783, Written Opinion dated Jul. 21, 2020", (Jul. 21, 2020), 5 pgs.

* cited by examiner

STATE OF THE ART

STATE OF THE ART

PICKLING PLANT AND PROCESS

PRIORITY APPLICATIONS

This application is a U.S. National Stage Filing under 35 U.S.C. § 371 from International Application No. PCT/IB2020/053783, filed on Apr. 22, 2020, and published as WO2020/217180 on Oct. 29, 2020, which claims the benefit of priority to Italian Application No. 102019000006234, filed on Apr. 23, 2019; the benefit of priority of each of which is hereby claimed herein, and which applications and publication are hereby incorporated herein by reference in their entireties.

TECHNICAL FIELD

The invention relates to a continuous pickling plant for the treatment of metal products in the form of a strip comprising a plurality of acid solution process tanks each divided into a plurality of turbulence cells; and an acid solution recirculation system in which preferably the solution discharged from the overflow of each process tank feeds an external recirculation tank through a discharge pipe from which the acid solution is returned by a pump through an inlet pipe to the process tank, optionally passing through a heat exchanger to be heated. The products treated are in particular hot rolled strips. Pickling is used to remove the layer of oxides present on both the upper and lower surfaces of these strips.

BACKGROUND ART

Hot rolled carbon steel strips (low, medium, high and high strength) are coated with a layer of oxides having different mechanical characteristics with respect to those of the base material, thus in cases where the strips must undergo subsequent deformation or coating with metal or organic coatings this layer of oxides must be eliminated.

The most commonly used technology is to remove oxides through chemical etching in so-called pickling tanks using an acid bath.

Usually the most used tanks are those of sulphuric acid $H_2SO_4$ or hydrochloric acid HCl. The latter is used most by manufacturers as it guarantees a high scale removal capacity and allows obtaining a shiny surface free of oxide residues.

Multiple tanks (three to four) are used in the art where the strip moves counter-current to the acid stream so that the oxidized strip first encounters a solution with more dissolved iron (Fe) and less free acid, vice versa at the end of the process when all the oxide is removed and the solution has more free acid and less dissolved Fe.

The kinetics of the chemical process are favoured by temperature: raising it increases the removal rate of the oxides, the time therein (process speed, i.e. time in the tanks), the concentration of acid and turbulence inside the acid bath (the higher the speed of the fluid, the greater the ability to dissolve the oxides).

The classic system (Deep Tank Pickling) involves the passage of the strip arranged according to a catenary in a very deep tank. To minimize the dragging of acid from one tank to another and therefore to allow the control of the concentration of acid, drag dams are inserted. The system does not guarantee optimization of the amount of acid. Shallow Tank Pickling tanks are a development of this type of tank, in which the coefficient of exchange on the lower face of the strip is increased thanks to a shorter distance between the lower face and the bottom of the tank. The tanks are separated from each other by squeezing belts. The tanks then developed to pass to Turbulent Pickling, in which the tanks are fed by acid sprayers and in which an acid recirculation system is provided. The turbulence is not only determined by the movement of the strip but also by the effect of the sprayers. The most advanced system is the so-called Turboflo system which involves dividing each tank into turbulence cells equipped with a shaped cover to increase the turbulence and therefore the heat exchange. Good heat exchange ensures homogeneous and fast heating of the acid to the operating temperature. In addition, high turbulence favours the pickling reaction.

The advanced systems provide a back-flow effect of the acid in the opposite direction with respect to the forwards direction of the strip. The back-flow effect, the hydraulic seal created by acid injectors at the entrance and exit of the tank, the provided squeeze rollers and a cascade tank arrangement facilitate controlling concentration in each tank. Turbulence cell tanks are for example described in documents EP 1 054 079 B1, U.S. Pat. Nos. 5,803,981 and 4,807,653. The latter document also describes a possible acid recirculation system in detail.

The design of the tanks in the above sense allows controlling the turbulence through the use of spray systems in the direction of travel or on the sides, moreover the turbulence can be favoured by the geometric arrangement of covers and tank bottoms that can create turbulence cells.

The turbulence effect of the acid solution is maximized by creating horizontal treatment tunnels inside which the strip flows and obtaining a hydraulic seal with acid jets at the entrance and exit; while being very effective, these systems have the disadvantage that as the strip speed increases, the seal pressure in output must increase to reach 4-5 bar for process speeds between 400 and 500 m/min. High pressures involve the use of expensive acid recirculation pipes for safety reasons: it must be ensured that under operating conditions no leakage of acidic solution under pressure can occur.

The state of the art employs special covers that force the strip to immerse itself under the free surface using small diameter rollers that are inserted in the upper covers. This system eliminates the need for hydraulic seals, but has a drawback related to the cost of rollers made of special materials adapted to resist the acidic solution in which they are completely immersed.

In addition to the above, in the state of the art the first pickling tank is used to heat the strip from the ambient temperature (−5 to +25° C.), which depends on the geographical location of the system, to the process temperature of the tanks from +70 to +85° C. This aspect, in addition to the fact that the first tank also has a low concentration of free acid, has a negative impact on the oxide removal capacity of the first tank that results close to zero.

The pickling systems described in documents U.S. Pat. Nos. 5,060,683 A and 4,996,998 A also provide for a pre-heating of the strip with a low concentration acidic solution.

The current performance of acid pickling tanks is also put to the test by the continuous development of steels, especially those for automotive and electrical applications. The presence in the chemical composition of these steels of elements such as manganese (Mn) or silicon (Si) is caused by the presence of oxides that are more difficult to eliminate than those of iron and this results in an increase in their time inside the tanks, usually equal to 1.5 times to 4 times the time a strip of equal size of low carbon steel remains inside. The time inside varies depending on the weight concentration of the problematic element in the chemical composition of the steel and the wrapping temperature of the hot train.

In addition, these steels have the particularity that the tough Mn and Si oxides are arranged at the interface between the oxide layer and the base material, while the surface oxide layer is composed of easily removable iron oxides; and in the last tank these tough oxides must be removed.

DISCLOSURE OF THE INVENTION

Considering the above, it is clear that there is a need to revise the pickling tanks in order to eliminate the drawbacks indicated above. An object of the invention is to propose a pickling plant and process that optimize pickling in terms of efficiency and speed. A further object of the invention is to propose a pickling plant in which the pickling in the first tank is not almost null. Another object of the invention is to provide a plant that does not require hydraulic sealing sprays at the entrance and exit of the tanks.

The object is achieved by a continuous pickling plant for the treatment of metal products in the form of a strip or tube, comprising (a) a plurality of acid solution process tanks each divided into a plurality of turbulence cells;

(b) an acid solution recirculation system in which preferably the solution discharged from the overflow of each process tank feeds through a discharge pipe an external recirculation tank from which the acid solution is returned by a pump through an intake pipe to the process tank, optionally passing through a heat exchanger to be heated; and (c) a heating device of the metal product upstream of the plurality of process tanks, in which said heating device is an induction heating system and/or a water spray tank.

In a preferred embodiment of the invention, each pickling tank has a discharge pipe that feeds an external recirculation tank, from which the acid is re-pumped to the pickling tank by a pump or multiple pumps in which it is advantageously possible to obtain a pressure not exceeding one bar immediately upstream of the turbulence sprays.

Conveniently the recirculation pump(s) can operate at variable speed thanks to a controlled, variable frequency voltage electric motor in order to modulate the acid flow rate to the tank. Advantageously, the recirculation tank is connected with the other recirculation tanks present through a pipe that allows the acid to pass counterflow with respect to the direction of the strip.

Preferably, within the cycle, before feeding the pickling tank, i.e. before the acid returns to the tank, it is heated by a heat exchanger, usually steam/acid (but other exchangers are conceivable) that controls its temperature in a range from 65 to 85° C.

Preferably, the exchangers for each process tank are dimensioned only to maintain the predetermined temperature by compensating for heat losses in the environment and any heating necessary for the addition of acid or water at temperatures lower than the predetermined one.

The presence of heating devices relieves the first tank of the task of heating the strip, which thus becomes fully active for pickling purposes.

The mentioned heating devices can be used as alternatives or at the same time:

The first device is an induction heating system, the second a water spray tank. The induction heating device is preferred, which takes up less space inside the plant and is not complex but very effective.

The upstream heating of the pickling tanks increases the efficiency of the first pickling tank. Advantageously, the induction heating device is dimensioned for a temperature difference from +15° C. to +40° C., usually about +25° C. In the case of the water spray heating device, it is advantageously a heating spray tunnel for a temperature difference from +20° C. to +50° C., usually about +45° C.

Advantageously, the strip preheating system consisting, for example, of an induction heater and/or a water spray heating tank allows the strip to be preheated to a temperature between 65 and 75° C. so that in subsequent acid tanks only ambient leaks are taken into account and the exchangers must not be sized, particularly in the first tank, to also heat the strip.

An induction heating device allows a quick thermal response to each change in the size of the strip entering the pickling process. The inductor is advantageously sized for a partial thermal variation to minimize the power absorbed by the same, reducing the cost of runover and consumption of electrical power.

In advantageous embodiments of the invention, the spray tunnel allows effectively using the overflow rinse water, which is collected in a dedicated tank and sent with a dedicated spray pump with a pressure from 1 to 3 bar per nozzle (usually about 2 bar).

A suitable heat exchanger is preferably installed on the tunnel delivery pipe to control the temperature of the water sent to the sprays from +60° C. to +80° C., usually about +70° C.

The spray tunnel advantageously placed at the entrance of the first tank also performs the following additional functions:

(1) It is used for the pre-cleaning of the strip entering the pickling tanks by removing any oxide dust on the strip surfaces; for this reason, the return of the water to the recirculation tank provides appropriate filters to remove the sludge due to the dust of the oxides removed. The oxide powders are due to the various bending and flexion actions to which the strip was subjected before entering the pickling section, as this oxide powder is no longer integral with the scale layer and if there was no spray heating tank it would go into the acid pickling tanks, consuming unnecessary acid.

(2) Acid washing of the strip can occur in the case of a reverse direction of the process section. Preferably, in this case the pH and conductivity are controlled to avoid the excessive acidification of the water, providing for an automatic discharge of the same to the acid regeneration station. In other words, the water heating tank can be used as a washing tank in all cases where the strip present in the acid tanks must be moved backwards for operational reasons.

In a preferred embodiment of the invention, the temperature of the strip exiting the heating device, for example exiting the induction heater and/or the spray heating tank, is measured by suitable temperature measuring devices. Advantageously, the signal generated therefrom is sent to a control unit to obtain closed loop temperature control in order to maintain the temperature deviation of the strip preferably in a tolerance range of ±2-5° C.

In a very advantageous embodiment of the invention, the plant comprises one or more devices to increase the turbulence in the acid solution. As initially illustrated, the increase in turbulence increases the pickling reaction rate and shortens the time the strip stays inside the tanks. Possible devices for this purpose, which may be used alone or in combination thereof are:

(i) upper and lower turbulence sprays placed at the entrance and exit of the first and last turbulence cell of each tank;

(ii) in the last pickling tank and precisely in the first turbulence cell, a pickling accelerator consisting of a series of upper and lower acid spray bars; and (iii) turbulence fins arranged inside each turbulence cell.

Preferably, each cell is divided by the passing strip into an upper part and a lower part. The submerged strip is processed in a horizontal tunnel consisting of a series of tanks having turbulence cells divided into an upper part located under the cover of the tanks and above the strip and a lower part located at the bottom of the tank below the strip. These cells are for example delimited by inlet and outlet granite thresholds coinciding for the upper and lower parts. The upper turbulence sprays are located at the upper part and the lower sprays at the lower part. These sprays are preferably immersed below the level of the free surface of the acid in the tank.

Not having a sealing function, the inlet and outlet sprays (in particular when immersion rollers are provided) can be designed for pressures usually lower than 1 bar with obvious repercussions on the dimensioning of the recirculation pipes, simplifying the choice of materials and design criteria and allowing a substantial benefit in cost.

Turbulence fins can be located in the most varied positions within the cell, such as at the bottom of the tank or on ramps inserted in the cells to create an acid recirculation within the cell, as described in EP 1 054 079 B1. In addition to the protection/separation granite thresholds, the upper, lower and side walls of each cell can have these fins that allow the increase of turbulence inside the cell.

The upper and lower spray bars are responsible for accelerating the pickling by increasing the turbulence. They can be found in the above mentioned upper and lower parts of the cell. The accelerators are useful with hard-to-pickle strips, such as Si or Mn steels.

Advantageously, spray bars are placed at the entrance and exit of the tunnel to increase the turbulence on both the upper and lower surface of the strip. In addition, to facilitate the removal of the oxides on the edge of the strip, side nozzles, usually but not necessarily four in number, are advantageously provided on the edge of the tank.

For cases where the pickling process must process steel strips with significant Si and/or Mn contents, in view of the peculiar characteristics of these oxides, it is useful to introduce this pickling accelerator concept in the process section, to be activated when these types of steels are treated.

From the considerations made above relating to the morphology of the oxides of these steels, it is appropriate to insert this system in the last pickling tank.

For this purpose, this system solution can provide for the insertion of different spray ramps located above and below the surfaces of the strip, depending on the type of materials to be treated and the designed process speed; the number of spray ramps can vary, for example from two to eight per surface, usually at least four will be installed.

These additional spray bars are advantageously fed by a dedicated pump located at the recirculation tank of the last pickling tank. This spray bar system is usually disconnected and only activates when process conditions require it.

As already explained above, advantageously, the presence of an external recirculation tank is maintained, into which the acid is discharged in the event of a tank stop, in the feed section to the tank with a maximum pressure of 1 bar at the nozzles. The heat exchanger for heating the solution is also advantageously inserted.

In a preferred embodiment of the invention, the pickling plant further comprises at the entrance and exit of each tank immersion rollers dimensioned such that the level of overflow of the free surface of the acid solution is lower than the central axis of the roller, where these rollers define the passage of the metal product in the turbulence cells by dividing them into an upper turbulence cell and a lower turbulence cell. Immersion rollers, also of small diameters, make the use of hydraulic seal sprays and high-seal pipes unnecessary.

The rollers are ideally inserted after a pair of inlet drying rollers or squeezers and before the outlet rollers. The diameter defined above, i.e. ensuring the position of the roller shaft above the overflow of the free surface of the tank, ensures that the bearings are never in contact with the acid solution.

In a further advantageous embodiment of the invention, the pickling plant further comprises upstream of the pump of the first process tank a pipe with a suitable regulation valve for adding fresh acid. The insertion of this additional equipment helps increase the efficiency of the first pickling tank. The fresh acid can in exemplary form have a concentration of HCl of from 150 to 200 g/L, usually about 180 g/L and an iron concentration from 0 to 40 g/L, usually about 20 g/L. The addition of iron serves to lower the concentration of the acid. The temperature of the fresh acid usually ranges from +10° C. to +50° C., usually around +40° C. To facilitate the effective action of the addition of fresh acid, the same is advantageously added immediately upstream of the delivery pump to have a complete mixing.

This further embodiment of the invention is therefore related to the possibility of increasing the concentration of acid in the first tank, in all cases where it is necessary to increase the ability to remove the pickling oxide. This system consists in the possibility of delivering fresh acid immediately upstream of the pump(s), using for example an automatic valve such as a controlled opening valve and a supply delivery tube of the first pickling tank.

In the case of customers characterized by low production volumes and a mix of easily pickled products (set of low toughness oxides and minimum thickness of the same), a solution suitable for the purpose based on only two pickling tanks has been devised.

In this way, the solution with three or four tanks can be reserved only for customers with medium-high needs both in terms of production volume and in terms of the amplitude of the mix to be treated.

In particular, in the case of only two process tanks, it is evident that appropriate modifications to the recirculation system are necessary to avoid an inadequate concentration of Fe in the spent solution discharged to the acid regeneration plant.

For this purpose, in a particularly advantageous embodiment of the invention, the system provides for the presence of only two process tanks where in the last tank there is provided, preferably on the bottom thereof, a first overflow drain with a low iron concentration and a second overflow drain at increased iron concentration, where the two drains feed a respective recirculation tank that for this purpose contains a first chamber for the solution at low iron concentration and a second chamber for the solution at increased iron concentration, separated by a wall of weir.

In other words, in order to obtain a gradual increase of the iron in solution, the following measures are therefore envisaged: the addition of an overflow drain placed at approximately one or two thirds of the length of the process tank in addition to the existing drain at the end of the tank and the division of the recirculation tank into two halves by inserting an overflow barrier in order to obtain a different concentration of Fe and acid in the two halves. The delivery pumps are advantageously dedicated to each half of the recirculation tank.

An embodiment of the invention thus allows hot rolled strips to be processed only with two pickling tanks. In order to avoid an incorrect use of the acid and to allow the production of spent acid with the correct amount of Fe, a modification of the recirculation system and pickling tank was necessary and resolved by the invention, and precisely the solution consists in an overflow drain at low concentration of Fe and one at increased concentration realized in the pickling tank placed as the last tank, in which the two drains pour the solution into the recirculation tank, where two chambers separated by a wall of weir are realized. In this way there will be a different concentration of Fe between the two chambers, thus obtaining a correct use of the acid solution.

It is understood that a last tank with the innovative acid recirculation system can be provided not only within a plant with a succession of only two process tanks, but also in plants containing three or more pickling tanks.

Considering that the audience of potential users of pickling plants according to the invention can be very heterogeneous both in terms of expected tons/hour or tons/month capacity of the plant and in terms of production mix, the above described applications are designed so as to be modular among themselves, allowing a simple definition of the plant, being constituted by a set of easily addable or removable modules.

Another aspect of the invention relates to a pickling process, preferably performed with a plant according to the invention, which comprises the following steps:

a) a pre-heating of a strip-shaped metal product, preferably a hot rolled strip, by a heating device, preferably selected among an induction heating system and/or a water spray tank;
b) pickling of the strip with removal of the scale in a plurality of solution process tanks with acid solution.

Advantageously, the metal product is immersed in the acid by means of immersion rollers as described above that define the passage of the strip in the turbulence cells. Advantageously, the scale removal capacity is controlled through the acid flow rate regulated by acid sprays entering and exiting the tanks.

Preferably, the descaling capacity of the first process tank is increased by introducing fresh acid into the first tank.

In an embodiment of the process according to the invention, the turbulence inside the tanks is increased by inserting into the tanks one or more of the devices (i) to (iii) of claim 2, in particular the devices with pickling acceleration capacity.

A further aspect of the invention relates to a pickling tank with multiple turbulence cells equipped with one or more of the devices for increasing turbulence according to claim 2. Optionally, this tank is further provided with an acid recirculation system and a system for adding fresh acid therein, within the meaning of the fourth claim.

A further aspect of the invention relates to a pickling tank which provides in the tank, preferably at the bottom thereof, a first overflow drain with a low iron Fe concentration and a second overflow drain at increased iron Fe concentration, where the two drains feed a respective recirculation tank connected to said tank which for this purpose contains a first chamber for low Fe concentration and a second chamber for increased Fe concentration, separated by a wall of weir.

In a preferred embodiment of the invention, the plant according to the invention comprises a tank of the type just described as the last tank. Upstream of this tank can be inserted one or more, advantageously only one, "traditional" tank(s) that do not provide drains at different concentrations of iron that feed two chambers inside a recirculation tank separated by a wall of weir. Advantageously, the plant comprises a strip pre-heating system upstream of all the tanks as described above.

The features described for one aspect of the invention may be transferred mutatis mutandis to the other aspects of the invention.

Referring to FIGS. 3 to 6, preferred embodiments of a continuous pickling plant according to the invention for removing the oxide layer from hot rolled strips are depicted.

Further features and advantages of the invention will become more apparent in light of the detailed description of the preferred, but not exclusive, embodiments of a pickling plant and process, illustrated by way of non-limiting example with the aid of the accompanying drawing tables wherein the same reference numbers in the figures identify the same elements or components and the last two identical digits of each reference number correspond to the same type of element in different embodiments.

DESCRIPTION OF PREFERRED EMBODIMENTS

FIG. 1 shows the diagram of a continuous pickling plant including the acid recirculation system according to the state of the art.

Figure 2:
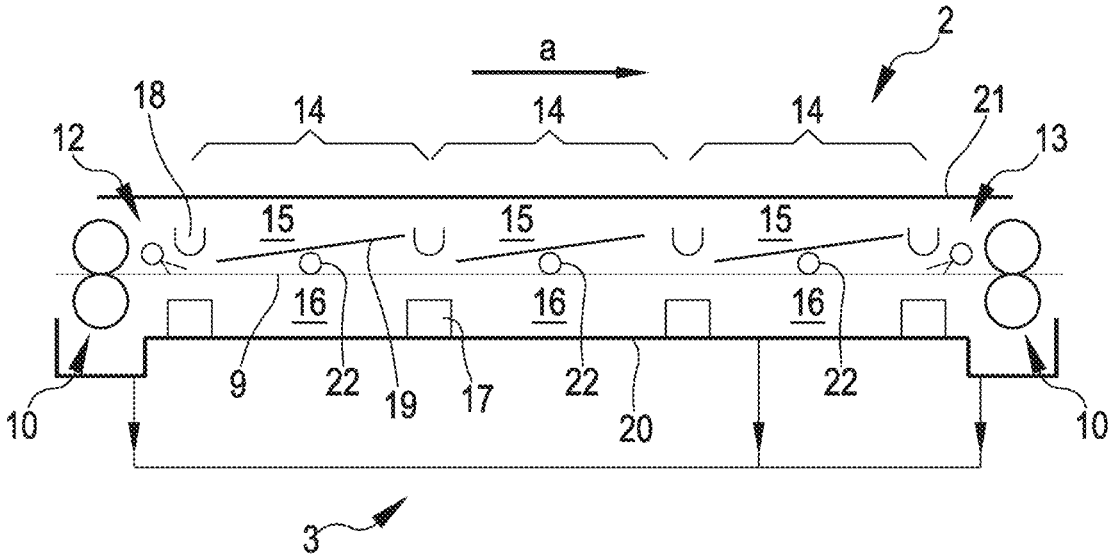

FIG. 2 schematically shows in lateral section the realization of the process tanks including the turbulence cells of the plant of FIG. 1 according to the state of the art.

Figure 3:
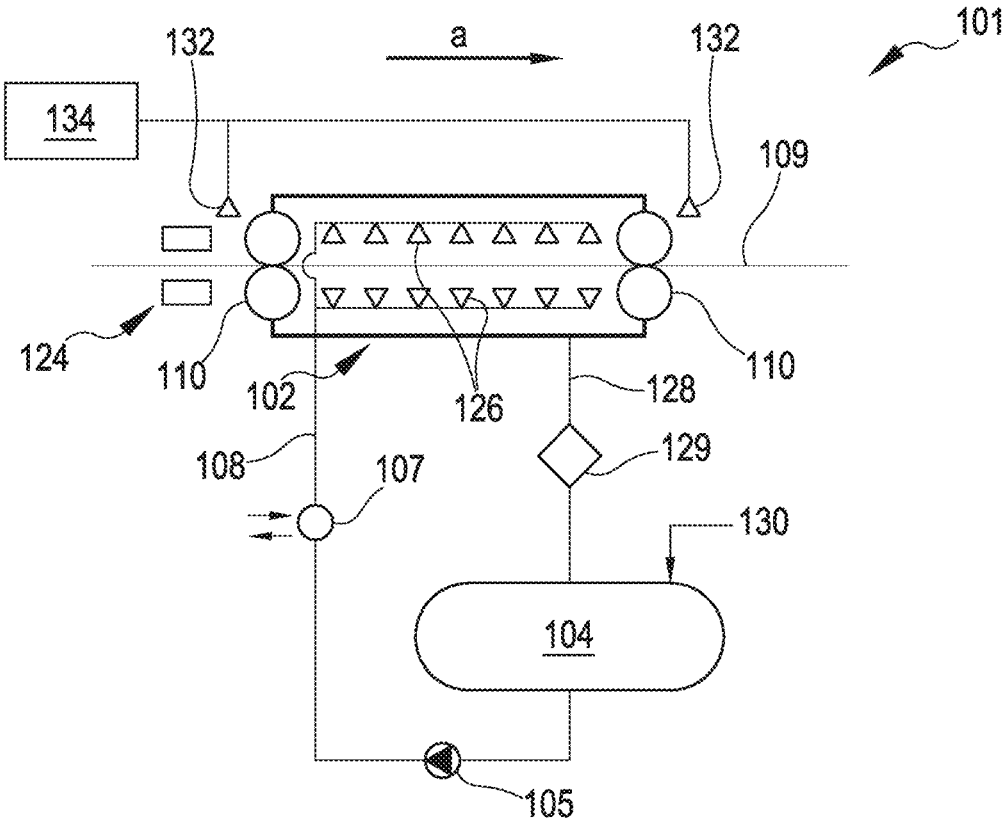

FIG. 3 schematically shows in lateral section an embodiment of a pickling plant according to the invention equipped with elements for pre-heating the strip entering the pickling tanks.

Figure 4:
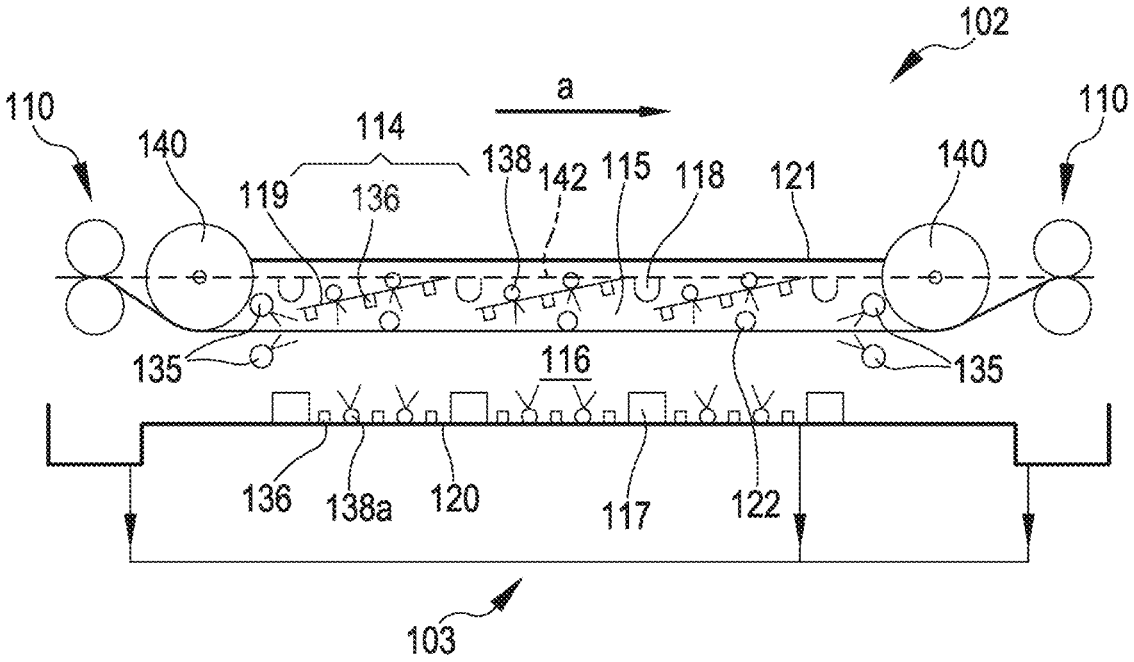

FIG. 4 schematically shows in lateral section an embodiment of a pickling tank according to the plant of the invention equipped with elements for increasing the turbulence in the plant.

Figure 5:
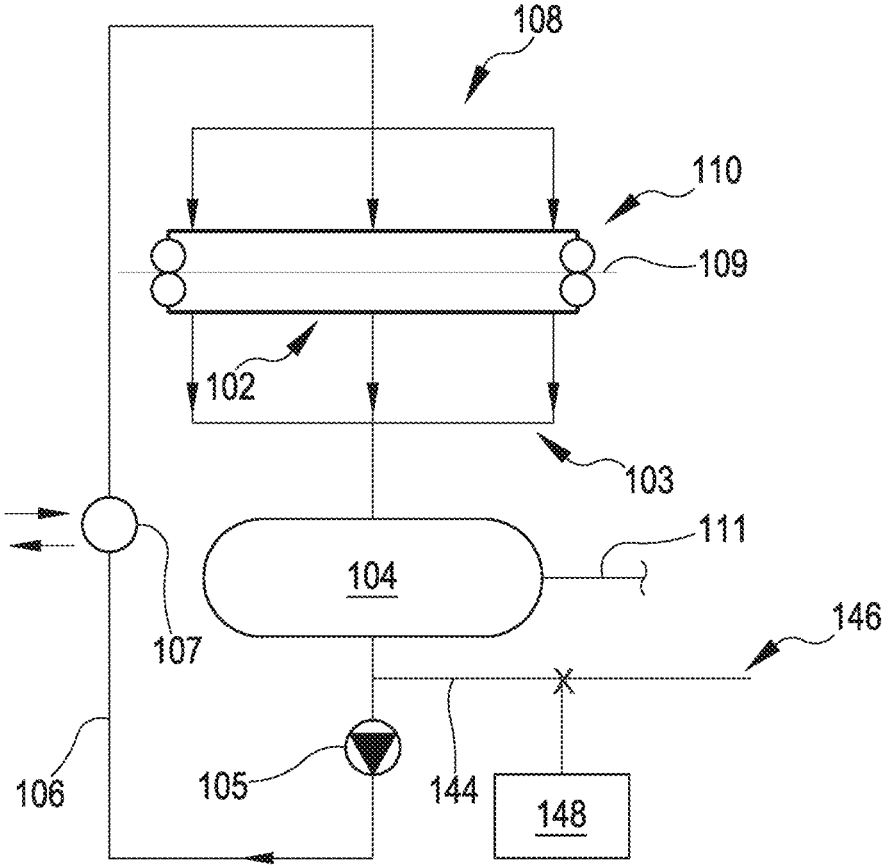

FIG. 5 schematically shows in lateral section another embodiment of a pickling plant according to the invention equipped with a variant for introducing acid into the first tank of the plant.

Figure 6:
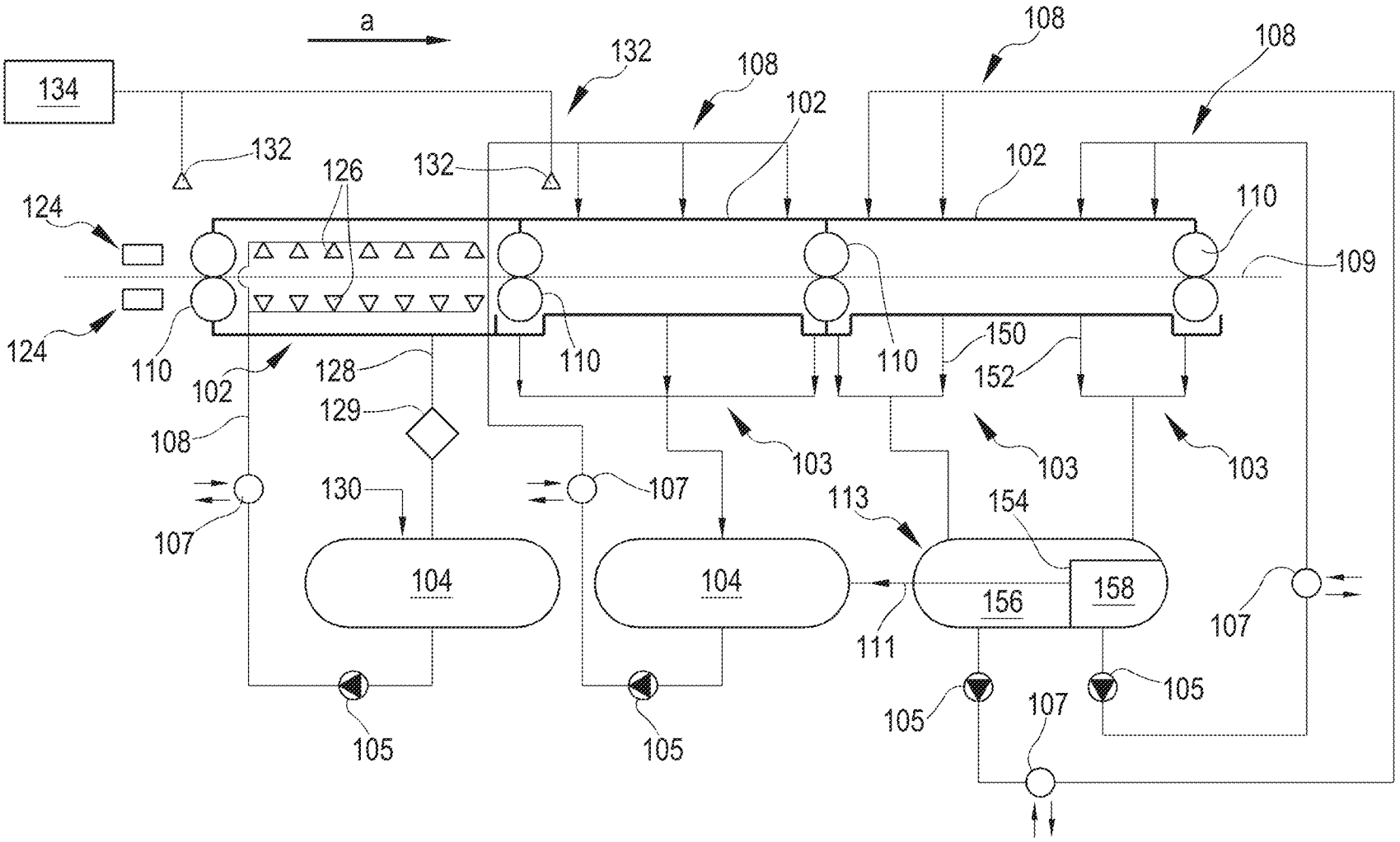

FIG. 6 shows a schematic view of a plant with only two continuous pickling tanks preceded by a strip pre-heating unit.

FIG. 1 shows the diagram of a continuous pickling plant 1 including the acid recirculation system according to the state of the art. A succession of three pickling tanks 2 is noted. Systems of discharge pipes 3 remove the liquid contained in the tanks 2 and transport it to the respective drain tanks 4. From each tank 4 the liquid is guided by a delivery pump 5 along a recirculation pipe 6 equipped with a heat exchanger 7 through relative systems of intake pipes 8 back into the corresponding pickling tank. A metal strip 9 passes through the tanks 2 in the direction of the arrow a meeting at the beginning of the line, at the end of the same and between the tanks 2 of the squeezer rollers 10. The drain tanks 4 connected together in cascade with the opposite travel direction of the strip (arrow a) through pipes 11.

FIG. 2 schematically shows in lateral section the embodiment detail of a single process tank including turbulence cells also present in the plant of FIG. 1, as known in the state of the art. At the entrance and exit of the tank 2, note two pairs of squeezer rollers 10, useful for dragging the product, preventing it from retaining excessive acid. At the entrance and exit of each tank 2 are positioned respectively inlet hydraulic seal sprays 12 and outlet hydraulic seal sprays 13 adapted to limit the leakage of acid from the tank. The tank 2 is divided into a series of turbulence cells 14 each composed of an upper turbulence and recirculation cell section 15 and a lower turbulence cell section 16, separated from each other by the strip 9 being processed. The individual cells 14 are separated from each other at the lower part by stone blocks 17 and at the upper part by rounded blocks 18. Note also inclined panels 15 or ramps that serve, together with the elements 17, 18 to create turbulence by favouring the recirculation of the liquid inside the cell; this is well known in the art and is described, for example, in the document EP 1 054 079 B1. The discharge pipe system 3 is also depicted. The cells are enclosed below by a tank bottom 20 and above by a cover 21. To further increase turbulence within the tank, a number of lateral auxiliary sprayers 22 can be provided.

FIG. 3 schematically shows in lateral section an embodiment relating to the continuous pickling plant 101 according to the invention, provided with elements for pre-heating the strip 109 entering the pickling line. Only the first tank 102 of the plant is depicted. At the entrance and exit of the tank 102 there are pairs of squeezer rollers 110. Upstream of the first tank 102 relative to the feed direction (arrow a) of the strip 109 a heating unit is provided: for example, an induction or gas or resistance furnace 124 or the like, adapted to heat the strip before it enters the first tank 102. The depicted tank 102 is a heating tank which uses water and has a series of water sprayers 126, preferably arranged in spray tunnels that allow pre-heating the strip 109 to a temperature between 65 and 75° C. In fact, through the pipe 128 and passing through a self-cleaning filter 129 the discharge reaches the discharge tank 104 which can also be fed by the discharge of rinsing water 130. A delivery pump 105 forces the liquid to pass through a heat exchanger 107 fed by, for example, water vapour, which heats the passing liquid while it is again sent through the intake pipe 108 in the spray system 126 and thus heats the strip 109 passing through the tank 102. Suitable temperature measuring devices 132, e.g. infrared, are arranged upstream and downstream of the tank 102 and transmit temperature values to a temperature control unit 134 capable of controlling and regulating the temperature of the water fed to the water sprayers 126 and the induction heating system 124. In any case, said heating unit 124 and the water heating system 126 can be realized as alternatives or in combination.

FIG. 4 schematically shows in lateral section an embodiment of a pickling tank 102 according to the plant of the invention equipped, in particular, with elements for further increasing the turbulence in the plant. The elements depicted help increase the turbulence in the system and thus accelerate the pickling and can be used as alternatives or in various combinations therebetween. As already illustrated above with reference to the state of the art, for example, three turbulence cells 114 can be identified inside the tank 102. Each cell 114 is divided by the strip 109 into an upper turbulence cell 115 and a lower turbulence cell 116. The individual cells 114 are separated therefrom by lower blocks 117 and upper blocks 118, similar to that existing in the prior art. The tank 102 has a bottom 120 and a cover 121, as well as the inclined panels or ramps 119 as already described. Side sprayers 122 increase turbulence in a known manner. Lower and upper turbulence sprayers at the entrance and exit 135 further contribute to the increase in turbulence. Additional fins 136 that help increase turbulence are applied to the bottom 120 and/or the lower surface of the inclined panels 119. As additional pickling effect accelerators, particularly in the last tank, upper and lower sprayers 138 can be arranged applied to the bottom 120 of the tank 102 and/or to the lower surface of the inclined panels 119. This new solution also includes immersion rollers 140 of large diameter, which press the strip under the free surface 142 of the acid (dotted line). The large diameter ensures that the roller axis is always above the free overflow discharge surface 142 of the tank 102, so that the bearings are never in contact with the acid solution and last longer. The immersion rollers 140 thus render the hydraulic sealing sprays at the entrance and exit of the tank 102 superfluous, simplifying the layout.

FIG. 5 schematically shows in lateral section another embodiment of a pickling plant according to the invention equipped with a variant for introducing acid into the first tank 102 of the plant. For simplicity a diagram similar to that in FIG. 1 is illustrated, but it is understood that the plant can be further provided with one or more of the heating and/or turbulence increasing elements according to the invention and as depicted in FIGS. 3 and 4. Referring to FIG. 1, note a pipe 144 for the addition of fresh acid from a further tank not shown, arranged between the discharge tank 104 and the delivery pump 105. The amount of fresh incoming acid 146 is regulated by an automatic valve 148, and is arranged in case the solution is excessively diluted.

FIG. 6 shows a schematic view of a plant with only two continuous pickling tanks preceded by a strip pre-heating unit. The strip pre-heating unit was first described with reference to FIG. 3. The strip 109 exiting the pre-heating unit passes through a first pickling tank 104 equipped with a "traditional" acid recirculation system and subsequently through a second pickling tank 102 in which the acid recirculation system provides for an important difference with respect to the "traditional" one of the state of the art (see FIG. 1), namely the innovation that the discharge tank is fed by an overflow drain at a low concentration of iron 152 and an increased concentration drain 150 realized directly on the bottom of the pickling tank 102 placed as the second and last tank in the plant that is connected to the previous tank through the cascade pipe 111. The two drains 150 and 152 pour the solution into the recirculation tank 113 in which two chambers 156 and 158 are realized, separated by a wall of weir 154, thereby obtaining correct use of the acid solution.

During operation, further embodiment modifications or variants of the pickling plant and pickling process of the invention, not described herein, may be implemented. If such modifications or such variants should fall within the scope of the following claims, they should all be considered protected by the present patent.

The invention claimed is:

1. A continuous pickling plant for the treatment of metal products in the form of a strip or tube comprising:

(a) a plurality of acid solution process tanks each divided into a plurality of turbulence cells, (b) a recirculation system of the acid solution; and (c) a heating device of a metal product upstream of the plurality of process tanks, wherein said heating device is an induction heating system and/or a water spray tank, wherein a last acid solution process tank of the plurality of acid solution process tanks, on the bottom thereof, comprises a first overflow drain for a solution having a first iron concentration and a second overflow drain for a solution having a second lower iron concentration, wherein the two drains feed a recirculation tank that contains a first chamber for the first concentration of iron and a second chamber for the second lower concentration of iron, separated by a wall of weir.

2. The continuous pickling plant according to claim 1, wherein it comprises one or more devices to increase a turbulence in the acid solution selected from a group consisting of:

(i) upper and lower turbulence sprays placed at an entrance and exit of a first and last turbulence cell of each acid solution process tank;

(ii) turbulence fins arranged inside each turbulence cell; and (iii) in a first turbulence cell of the last acid solution process tank, a pickling accelerator consisting of a series of upper and lower acid spray bars.

3. The continuous pickling plant according to claim 1, wherein it further comprises:

(d) at an entrance and exit of each acid solution process tank immersion rollers dimensioned such that a level of overflow of a free surface of the acid solution is lower than a central axis of an immersion roller, wherein these immersion rollers define a passage of the metal product in the plurality of turbulence cells dividing them into an upper turbulence cell and a lower turbulence cell.

4. The continuous pickling plant according to claim 1, wherein it further comprises:

(e) upstream of a pump of a first acid solution process tank, a pipe with a suitable regulation valve for adding fresh acid.

5. The continuous pickling plant according to claim 1, wherein it further comprises:

(f) downstream of the heating device a temperature measuring device wherein a signal generated by the latter is sent to a closed loop control unit in order to maintain a temperature deviation of the metal product within a tolerance range, of ±2-5° C.

6. The continuous pickling plant according to claim 1, wherein the plant provides for the presence of only two acid solution process tanks.

7. The continuous pickling plant according to claim 1, wherein a solution discharged from an overflow of an acid solution process tank feeds through a discharge pipe and an external recirculation tank from which the acid solution is returned by a pump through an intake pipe to the acid solution process tank by optionally passing through a heat exchanger to be heated.

8. A pickling process, performed with a plant according to claim 1, comprising the following steps:

a) a pre-heating of a strip-shaped metal product by means of a heating device, wherein said heating device is an induction heating system and/or a water spray tank;

b) pickling of a strip with removal of a scale in a plurality of acid solution process tanks with acid solution.

9. The pickling process according to claim 8, wherein a descaling capacity of a first acid solution process tank is increased by introducing fresh acid into the first acid solution process tank.

10. The pickling process according to claim 8, wherein a turbulence inside the plurality of acid solution process tanks is increased by inserting into the plurality of acid solution process tanks one or more of:

(i) upper and lower turbulence sprays placed at an entrance and exit of a first and last turbulence cell of each acid solution process tank;

(ii) turbulence fins arranged inside each turbulence cell; and (iii) in a first turbulence cell of the last acid solution process tank, a pickling accelerator consisting of a series of upper and lower acid spray bars.

11. The pickling process according to claim 10, wherein the one or more of the devices from (i) to (iii) are devices with acceleration capacity.

12. The pickling process according to claim 8, wherein the strip-shaped metal product is a hot-rolled strip.

* * * * *